US009364054B2

(12) United States Patent
Gittens et al.

(10) Patent No.: US 9,364,054 B2
(45) Date of Patent: Jun. 14, 2016

(54) ACCESSORY CINCHING DEVICE

(71) Applicants: Tristan S. Gittens, Palm Springs, CA (US); John T. Held, Carnation, WA (US)

(72) Inventors: Tristan S. Gittens, Palm Springs, CA (US); John T. Held, Carnation, WA (US)

( * ) Notice: Subject to any disclaimer, the term of this patent is extended or adjusted under 35 U.S.C. 154(b) by 0 days.

(21) Appl. No.: 14/248,748

(22) Filed: Apr. 9, 2014

(65) Prior Publication Data

US 2015/0289609 A1 Oct. 15, 2015

(51) Int. Cl.
*A44C 5/22* (2006.01)
*A43C 1/06* (2006.01)

(52) U.S. Cl.
CPC .... *A44C 5/22* (2013.01); *A43C 1/06* (2013.01)

(58) Field of Classification Search
CPC ..... A43C 1/06; A43C 1/00; A43C 11/16; A43C 11/165; A43C 11/004; A43C 11/20; A43C 7/08; A43C 7/00; A44C 5/22; Y10T 24/3713; Y10T 24/2187; Y10T 24/2183; Y10T 24/3724; Y10T 24/37; B65H 2701/537
See application file for complete search history.

(56) References Cited

U.S. PATENT DOCUMENTS 1,165,320 A * 12/1915 Clary ..... B65D 63/14 24/18
2,139,315 A * 12/1938 Partin ..... A43C 7/08 24/712.7
3,345,707 A * 10/1967 Rita ..... A43C 7/00 24/712.2
3,500,508 A * 3/1970 Bennett ..... A43B 3/30 24/1
4,901,938 A * 2/1990 Cantley ..... B65H 75/44 242/378.1
5,315,741 A * 5/1994 Dubberke ..... A43C 7/00 24/115 G
6,015,110 A * 1/2000 Lai ..... B65H 75/28 242/388.1
6,158,096 A * 12/2000 Bar ..... A43C 11/20 24/114.9
6,502,286 B1 * 1/2003 Dubberke ..... A43C 7/00 24/712.1

(Continued)

*Primary Examiner* — Robert J Sandy
*Assistant Examiner* — Rowland Do

(57) ABSTRACT

An accessory cinching device for jewelry and footwear is disclosed. Jewelry device includes first cylindrical stationary housing with side wall, two pairs of side line holes, base collar, and bottom core hole. Each pair of side line holes is disposed on opposing sides of stationary housing. A second cylindrical rotating housing has at least two top line holes, top screw hole, top collar, and top core with at least two top core notches. A retaining nut has bottom core with at least two bottom core notches, bottom lip, and internal thread. Bottom core of retaining nut is adapted to be inserted up through bottom core hole of stationary housing. A screw is adapted to secure rotating housing to retaining nut. Base collar and bottom lip are adapted to maintain joined rotating housing, retaining nut, and screw, in alignment while allowing device to rotate relative to stationary housing when adjusting length of jewelry chain.

10 Claims, 6 Drawing Sheets

(56) References Cited

U.S. PATENT DOCUMENTS 7,497,101 B2 * 3/2009 Fawcett ..... E05B 45/005 242/382
7,516,914 B2 * 4/2009 Kovacevich ..... A42B 3/08 242/388.8
7,584,528 B2 * 9/2009 Hu ..... A43C 11/16 24/68 SK
7,617,573 B2 * 11/2009 Chen ..... A43C 1/00 24/68 SK
7,685,850 B2 * 3/2010 Nilsson ..... E05B 73/0052 242/382
8,245,371 B2 * 8/2012 Chen ..... A43C 7/00 24/68 B
8,353,088 B2 * 1/2013 Ha ..... A43B 3/0042 24/712.5
8,468,657 B2 * 6/2013 Soderberg ..... A43C 11/16 24/68 SK
8,499,595 B2 * 8/2013 Zhang ..... E05B 45/005 70/49
8,516,662 B2 * 8/2013 Goodman ..... A43C 11/165 24/68 SK
8,832,912 B2 * 9/2014 Ha ..... A43C 11/165 24/68 B
9,044,068 B2 * 6/2015 Neale ..... A43C 7/08
9,101,181 B2 * 8/2015 Soderberg ..... A43C 11/165
9,193,561 B2 * 11/2015 Yan ..... B65H 75/406
2006/0053845 A1 * 3/2006 Benda ..... E05B 67/006 70/18
2009/0172928 A1 * 7/2009 Messmer ..... A43C 7/00 24/68 SK
2012/0004587 A1 * 1/2012 Nickel ..... A61F 5/0118 602/21
2014/0223704 A1 * 8/2014 Chang ..... A43C 11/165 24/68 SK
2014/0308641 A1 * 10/2014 Tebben ..... G09B 19/0076 434/260
2014/0359981 A1 * 12/2014 Cotterman ..... A43C 11/20 24/712.9

* cited by examiner

ACCESSORY CINCHING DEVICE

TECHNICAL FIELD

The present invention relates to the field of adjusting and tightening devices for accessories such as jewelry and footwear, and more particularly, to accessory cinching devices for adjusting jewelry chains to a desired length and for securing shoelaces to a desired tightness or looseness, respectively.

BACKGROUND

Conventional adjusting devices have many disadvantages in that such devices are unable to adjust a necklace or chain without creating excess chain and lack the ability to adjust at any point along the chain instead of at finite points. In particular, the length of a jewelry chain can be adjusted by a few known methods. For example, the chain can be clasped at various points along the chain, or a cinching bead can be used to secure the chain tightly at various lengths. Both of these methods, however, leave the remaining chain to dangle down the user's back. Also, the first method is limited to the finite number of clasping points.

In addition, shoelaces can become loose, dangle, or create a trip hazard in that the shoelaces, including the remaining length, are not adequately secured in conventional tightening devices. Also, conventional devices are comprised of relatively many individual components or parts, which increase the production cost and may likely result in early wear and tear of such devices. It would thus be desirable to have an improved accessory cinching device for adjusting jewelry chains to a desired length and for securing shoelaces to a desired tightness or looseness, which avoids the disadvantages of the known devices.

SUMMARY

In a first aspect, there is provided herein an accessory cinching device for adjusting a jewelry chain to a desired length. The device includes a first cylindrical housing configured to be stationary and has a side wall, a first and second pair of side line holes, a base collar, and a bottom core hole. The first and second pair of side line holes are disposed on first and second opposing sides of the stationary housing such that each pair of the side line holes are separated from each other by a variable angle, as measured from a central axis of the stationary housing. A second cylindrical housing is configured to be rotating and has at least two top line holes, a top screw hole, a top collar, and a top core with at least two top core notches. The top collar is configured to provide alignment of the rotating housing disposed on top of the stationary housing and to maintain alignment of the jewelry chain slidably disposed through the side line holes. A retaining nut has a bottom core with at least two bottom core notches, a bottom lip, and an internal thread. The bottom core of the retaining nut is adapted to be inserted up through the bottom core hole of the stationary housing. A screw has a flat head and an external thread and is adapted to secure the rotating housing to the retaining nut. The at least two top core notches of the rotating housing and the at least two bottom core notches of the retaining nut are adapted to interlock to prevent the screw from over-tightening or backing out when the rotating housing is turned. The base collar and the bottom lip are adapted to maintain the joined rotating housing, the retaining nut, and the screw, in alignment while allowing the device to rotate relative to the stationary housing when adjusting the length of the jewelry chain.

In certain embodiments, the first cylindrical housing and the second cylindrical housing are configured to be concentric with each other in an assembled configuration.

In certain embodiments, the first pair of side line holes on a first opposing side of the stationary housing are configured to receive a first end of the jewelry chain slidably disposed therethrough and into the stationary housing such that the jewelry chain is threaded out through one of the at least two top line holes in the rotating housing and back into the second top line hole in the rotating housing. The jewelry chain is then threaded out through the second pair of side line holes on a second opposing side of the stationary housing where the first end of the jewelry chain is fastened to a second end of the jewelry chain with a clasp or other securing device.

In certain embodiments, the rotating housing is turned relative to the stationary housing to adjust the length of the jewelry chain.

In certain embodiments, the top core of the rotating housing and the bottom core of the retaining nut are adapted to form a spool around which the jewelry chain wraps when the rotating housing is turned relative to the stationary housing.

In certain embodiments, the jewelry chain is wrapped around the spool centered on an axis of rotation.

In certain embodiments, the rotating housing winds the jewelry chain around the spool and shortens the jewelry chain externally when the rotating housing is rotated in a tightening direction.

In certain embodiments, the rotating housing unwinds the jewelry chain around the spool and lengthens the jewelry chain externally when the rotating housing is rotated in a loosening direction.

In certain embodiments, each pair of the side line holes is separated from each other by about 45 degrees.

In certain embodiments, the device is configured to use friction to secure the jewelry chain at the desired length.

In a second aspect, there is provided herein an accessory cinching device for securing shoelaces to a desired tightness or looseness. The device includes a first cylindrical housing configured to be stationary that has a side wall, a base collar, a plurality of bottom line holes, and a bottom core hole. The plurality of bottom line holes are adapted to accommodate placement of the device on top of the shoelaces. A second cylindrical housing is configured to be rotating and has at least two top line holes, a top screw hole, a top collar, a top core with at least two top core notches, at least two lower clamp guides, and a shield ring. The top collar is configured to provide alignment of the rotating housing disposed on top of the stationary housing. A retaining nut has a bottom core with at least two bottom core notches, a bottom lip, and an internal thread. The bottom core of the retaining nut is adapted to be inserted up through the bottom core hole of the stationary housing. A screw has a flat head and an external elongated thread and is adapted to secure the rotating housing to the retaining nut. The at least two top core notches of the rotating housing and the at least two bottom core notches of the retaining nut are adapted to interlock to prevent the screw from over-tightening or backing out when the rotating housing is turned. A cap has a cap screw hole, at least two upper clamp guides, and at least two braces. The at least two braces are adapted to provide alignment of the cap with the rotating housing and the shield ring is adapted to maintain alignment of the cap. The base collar and the bottom lip are adapted to maintain the assembled rotating housing, the retaining nut, the screw, and the cap, in alignment while allowing the device to rotate relative to the stationary housing when securing the shoelaces to the desired tightness or looseness.

In certain embodiments, the first cylindrical housing and the second cylindrical housing are configured to be concentric with each other in an assembled configuration.

In certain embodiments, the rotating housing is configured to be positioned over the stationary housing and aligned so that the top core and the bottom core interlock.

In certain embodiments, the at least two lower clamp guides of the rotating housing, when aligned with the at least two upper clamp guides of the cap, allow shoelace ends to be secured in place and prevent the shoelace ends from being pulled back into the device during operation.

In certain embodiments, the top core of the rotating housing and the bottom core of the retaining nut are adapted to form a spool around which the shoelaces wrap when the rotating housing is turned relative to the stationary housing.

In certain embodiments, the shoelaces are wrapped around the spool centered on an axis of rotation.

In certain embodiments, the rotating housing winds the shoelaces around the spool and tightens the shoelaces externally when the rotating housing is rotated in a tightening direction.

In certain embodiments, the rotating housing unwinds the shoelaces around the spool and loosens the shoelaces externally when the rotating housing is rotated in a loosening direction.

In certain embodiments, the device is configured to use friction to secure the shoelaces to the desired tightness or looseness.

In certain embodiments, the device is configured to be positioned over the shoelaces on a top surface of a shoe tongue with the stationary housing facing downward.

Various advantages of this disclosure will become apparent to those skilled in the art from the following detailed description, when read in light of the accompanying drawings.

DETAILED DESCRIPTION

Figure 1A:
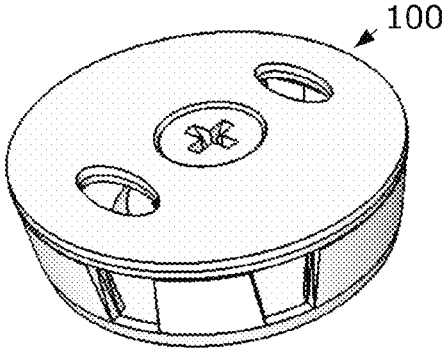
FIG. 1A is a top perspective view of an accessory cinching device for jewelry in an assembled configuration according to the present disclosure.

This disclosure is not limited to the particular apparatus, systems, methodologies or protocols described, as these may vary. The terminology used in this description is for the purpose of describing the particular versions or embodiments only, and is not intended to limit the scope.

As used in this document, the singular forms "a," "an," and "the" include plural reference unless the context clearly dictates otherwise. Unless defined otherwise, all technical and scientific terms used herein have the same meanings as commonly understood by one of ordinary skill in the art. All publications mentioned in this document are incorporated by reference. All sizes recited in this document are by way of example only, and the invention is not limited to structures having the specific sizes or dimensions recited below. As used herein, the term "comprising" means "including, but not limited to."

In consideration of the figures, it is to be understood for purposes of clarity certain details of construction and/or operation are not provided in view of such details being conventional and well within the skill of the art upon disclosure of the document described herein.

The present disclosure pertains to an improved accessory cinching device for jewelry and footwear that includes no gear teeth, ratcheting or otherwise, and instead uses friction to hold attached lines at the desired length, is simple to assemble with few components, has a low cost to manufacture, and is capable of functioning as an independent accessory with existing jewelry chains and footwear, and does not have to be part of a total system design, among other desirable features, as described herein.

Both embodiments of the accessory cinching device share maximum commonality of components or parts. To facilitate production, the number of separate components or parts is limited to the minimal number necessary to perform the cinching function of the device in a reliable and efficient manner. The various parts are designed such that dimensions, draft angles, and overhangs are amenable to standard fabrication processes such as three-dimensional (3D) printing and injection molding. The machine screw that is the central part of both embodiments of the accessory cinching device is designed with standard metric dimensions pursuant to ISO 261 to facilitate procurement of a ready-made item for this component.

As will be described in further detail below, the accessory cinching device for jewelry includes four parts, namely, a stationary housing, a rotating housing, a retaining nut, and a screw. The accessory cinching device for footwear includes four similar parts and a cap. The difference between the two embodiments is that the accessory cinching device for jewelry has line holes on the side of the stationary housing while the accessory cinching device for footwear has line holes on the bottom of the stationary housing. The cap in the accessory cinching device for footwear is included to allow the ends of the lines (i.e., shoelaces) to be secured firmly in place.

Figure 1B:
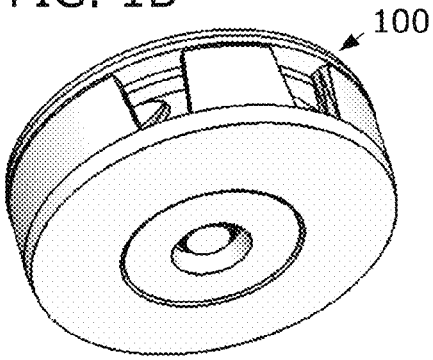
FIG. 1B is a bottom perspective view of the accessory cinching device for jewelry in an assembled configuration according to the present disclosure.
Figure 1C:
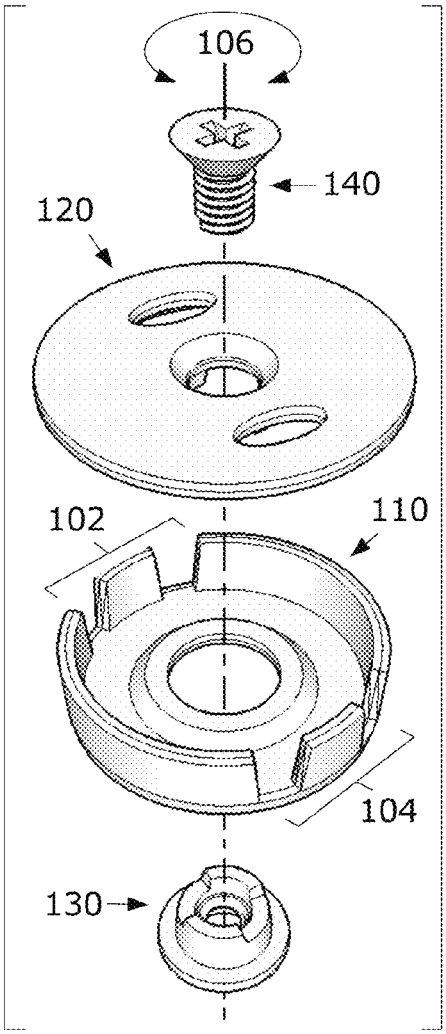
FIG. 1C is an exploded, top perspective view of the accessory cinching device for jewelry according to the present disclosure.
Figure 1D:
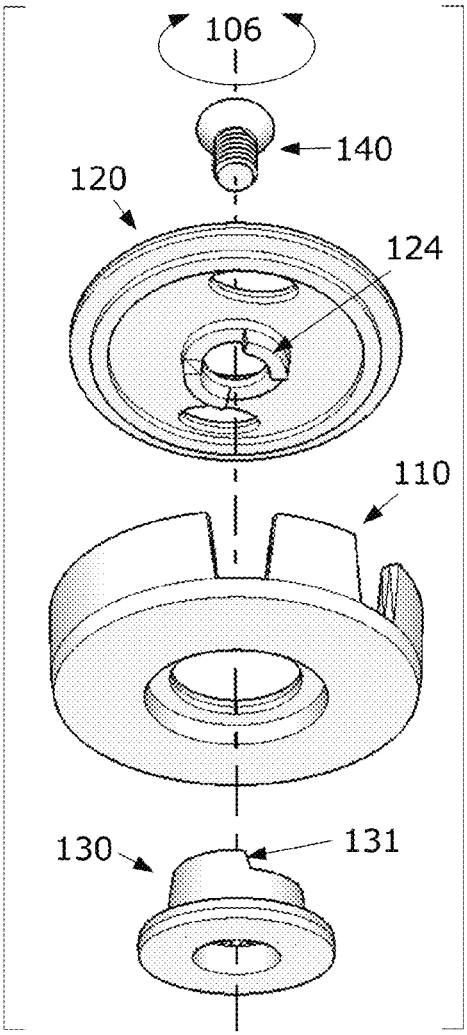
FIG. 1D is an exploded, bottom perspective view of the accessory cinching device for jewelry according to the present disclosure.
Figure 2A:
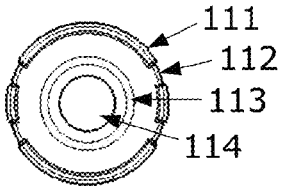
FIG. 2A is a top plan view of the stationary housing of the accessory cinching device for jewelry according to the present disclosure.

In a first embodiment of the accessory cinching device of the present disclosure, FIGS. 1A and 1B are top and bottom perspective views of the accessory cinching device for jewelry 100 shown in an assembled configuration. FIGS. 1C and 1D are exploded, top and bottom perspective views of the accessory cinching device for jewelry 100.

FIGS. 2A-2D are top plan, side elevation, bottom plan, and front or rear elevation views of a stationary housing 110 of the accessory cinching device for jewelry 100, respectively, according to the present disclosure.

As illustrated in FIGS. 1A-1D and FIGS. 2A-2D, the accessory cinching device 100 for adjusting a jewelry chain 101 (FIGS. 6A and 6B) to a desired length includes a first cylindrical housing 110 configured to be stationary and having a side wall 111, a first and second pair of side line holes 112, a base collar 113, and a bottom core hole 114. The first and second pair of side line holes 112 are disposed on first and second opposing sides of the stationary housing 110 such that each pair of the side line holes 112 is separated from each other by a variable angle, as measured from a central axis of the stationary housing. In some embodiments, each pair of the side line holes 112 is separated from each other by about 45 degrees.

Figure 3A:
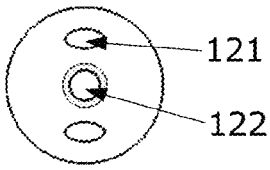
FIG. 3A is top plan view of the rotating housing of the accessory cinching device for jewelry according to the present disclosure.
Figure 2B:
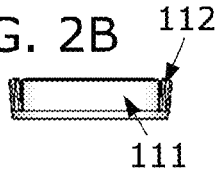
FIG. 2B is a side elevation view of the stationary housing of the accessory cinching device for jewelry according to the present disclosure.
Figure 2D:
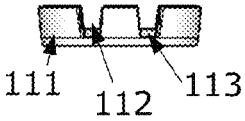
FIG. 2D is a front or rear elevation view of the stationary housing of the accessory cinching device for jewelry according to the present disclosure.
Figure 3B:
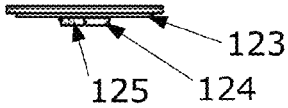
FIG. 3B is a front elevation view of the rotating housing of the accessory cinching device for jewelry according to the present disclosure.
Figure 2C:
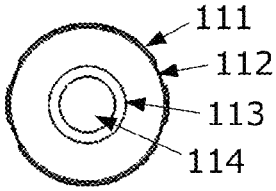
FIG. 2C is a bottom plan view of the stationary housing of the accessory cinching device for jewelry according to the present disclosure.
Figure 3C:
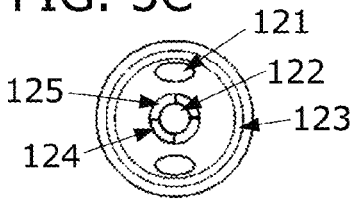
FIG. 3C is a bottom plan view of the rotating housing of the accessory cinching device for jewelry according to the present disclosure.
Figure 4A:
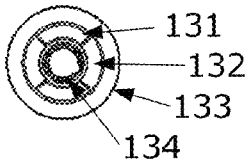
FIG. 4A is a top plan view of the retaining nut of the accessory cinching device for jewelry according to the present disclosure.

FIGS. 3A-3C are top plan, front elevation, and bottom plan views of a rotating housing 120 of the accessory cinching device for jewelry 100, respectively, according to the present disclosure.

As illustrated in FIGS. 1A-1D and FIGS. 3A-3C, the accessory cinching device for jewelry 100 further includes a second cylindrical housing 120 configured to be rotating and having at least two top line holes 121, a top screw hole 122, a top collar 123, and a top core 124 with at least two top core notches 125. The top collar 123 is configured to provide alignment of the rotating housing 120 disposed on top of the stationary housing 110 and to maintain alignment of the jewelry chain 101 (FIGS. 6A and 6B) slidably disposed through the side line holes 112.

FIGS. 4A-4D are top plan, side elevation, bottom plan, and front or rear elevation views of a retaining nut 130 of the accessory cinching device for jewelry 100, respectively, according to the present disclosure.

As illustrated in FIGS. 1C-1D and FIGS. 4A-4D, the accessory cinching device for jewelry 100 includes a retaining nut 130 having a bottom core 131 with at least two bottom core notches 132, a bottom lip 133, and an internal (female) thread 134. In assembly of the accessory cinching device 100, the bottom core 131 of the retaining nut 130 is adapted to be inserted up through the bottom core hole 114 of the stationary housing 110.

Figure 5A:
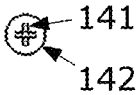
FIG. 5A is a top plan view of the screw of the accessory cinching device for jewelry according to the present disclosure.
Figure 4B:
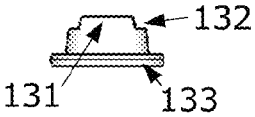
FIG. 4B is a side elevation view of the retaining nut of the accessory cinching device for jewelry according to the present disclosure.
Figure 4D:
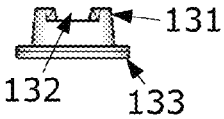
FIG. 4D is a front or rear elevation view of the retaining nut of the accessory cinching device for jewelry according to the present disclosure.
Figure 5B:
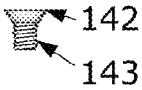
FIG. 5B is a front elevation view of the screw of the accessory cinching device for jewelry according to the present disclosure.
Figure 4C:
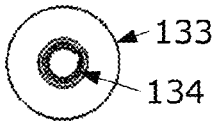
FIG. 4C is a bottom plan view of the retaining nut of the accessory cinching device for jewelry according to the present disclosure.
Figure 5C:
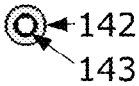
FIG. 5C is a bottom plan view of the screw of the accessory cinching device for jewelry according to the present disclosure.

FIGS. 5A-5C are top plan, front elevation, and bottom plan views of a screw 140 of the accessory cinching device for jewelry 100, respectively, according to the present disclosure.

As illustrated in FIGS. 1C-1D and FIGS. 5A-5C, the accessory cinching device for jewelry 100 further includes a screw 140 having a Phillips head indentation 141, a flat head 142, and an external (male) thread 143, such that the screw is adapted to secure the rotating housing 120 to the retaining nut 130. A standard Phillips head screwdriver is used with the Phillips head indentation 141 in screw 140 to secure the rotating housing 120 to the retaining nut 130. The at least two top core notches 125 of the rotating housing 120 and the at least two bottom core notches 132 of the retaining nut 130 are adapted to interlock to prevent the screw 140 from over-tightening or backing out when the rotating housing is turned during operation of the accessory cinching device 100.

Figure 6A:
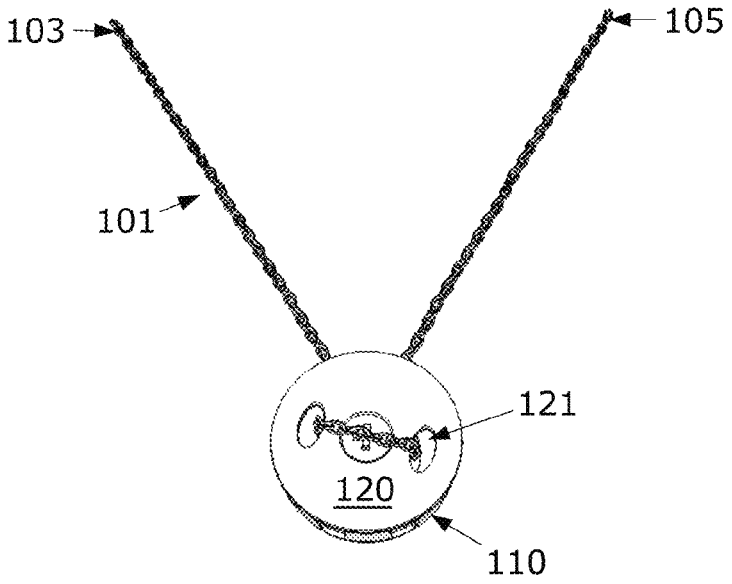
FIG. 6A is a front application of the accessory cinching device of FIG. 1A according to the present disclosure.
Figure 6B:
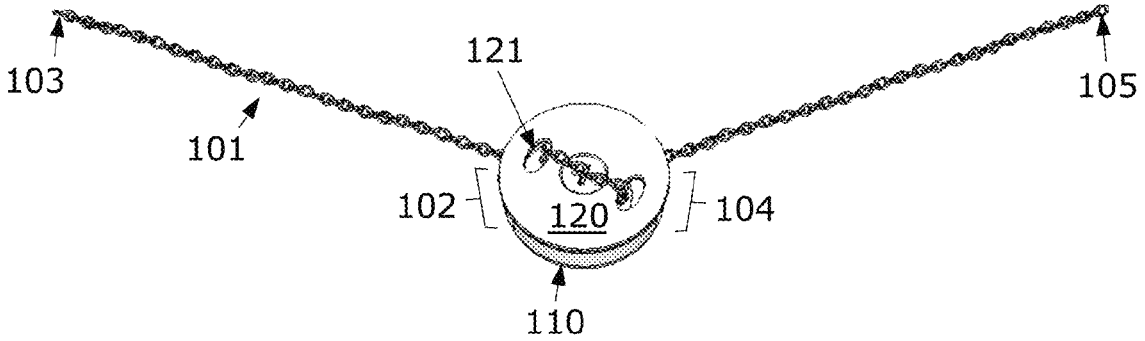
FIG. 6B is a rear application of the accessory cinching device of FIG. 1A according to the present disclosure.

The base collar 113 and the bottom lip 133 are adapted to maintain the assembly comprising the rotating housing 120, the retaining nut 130, and the screw 140, in alignment while allowing the assembly to rotate relative to the stationary housing 110 when adjusting the length of the jewelry chain 101 (FIGS. 6A and 6B).

In accordance with the present disclosure, the first cylindrical housing 110 and the second cylindrical housing 120 are configured to be concentric with each other in an assembled configuration as shown in FIGS. 1A and 1B.

Referring now to FIGS. 6A and 6B are front and rear applications of the accessory cinching device 100 according to the present disclosure. The first pair of side line holes 112 on a first opposing side 102 of the stationary housing 110 are configured to receive a first end 103 of the jewelry chain 101 slidably disposed therethrough and into the stationary housing 110 such that the jewelry chain is threaded out through one of the at least two top line holes 121 in the rotating housing 120 and back into the second top line hole 121 in the rotating housing. The jewelry chain 101 is then threaded out through the second pair of side line holes 112 on a second opposing side 104 of the stationary housing 110 where the first end 103 of the jewelry chain 101 is fastened to a second end 105 of the jewelry chain with a clasp or other securing device (not shown).

In operation of the accessory cinching device 100, the rotating housing 120 is turned relative to the stationary housing 110 to adjust the length of the jewelry chain 101 around a user's neck. It should be understood that the accessory cinching device for jewelry may be used with jewelry chains in addition to necklaces such as wrist and ankle bracelets, belts, and hair accessories.

In accordance with the present disclosure, the top core 124 of the rotating housing 120 and the bottom core 131 of the retaining nut 130 are adapted to form a spool (FIG. 1D) around which the jewelry chain 101 wraps when the rotating housing is turned relative to the stationary housing 110. The jewelry chain 101 is wrapped around the spool centered on an axis of rotation 106. The rotating housing 120 winds the jewelry chain 101 around the spool and shortens the jewelry chain externally when the rotating housing is rotated in a tightening direction (e.g., clockwise). The rotating housing 120 unwinds the jewelry chain 101 around the spool and lengthens the jewelry chain externally when the rotating housing is rotated in a loosening direction (e.g., counterclockwise). It should be understood that since there is no unidirectional ratcheting mechanism, the tightening direction can be either clockwise or counterclockwise, according to the user's choice, and the loosening direction is then the opposite of the chosen tightening direction. The accessory cinching device 100 is configured to use friction to secure the jewelry chain 101 at the desired length.

Figure 7A:
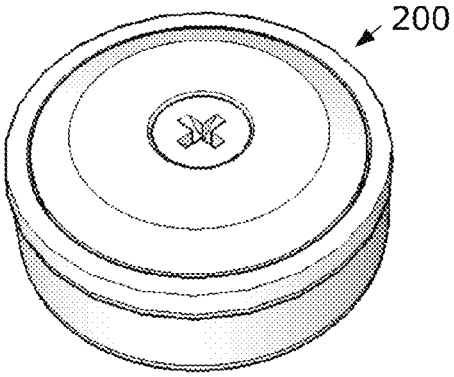
FIG. 7A is a top perspective view of an accessory cinching device for footwear in an assembled configuration according to the present disclosure.
Figure 7B:
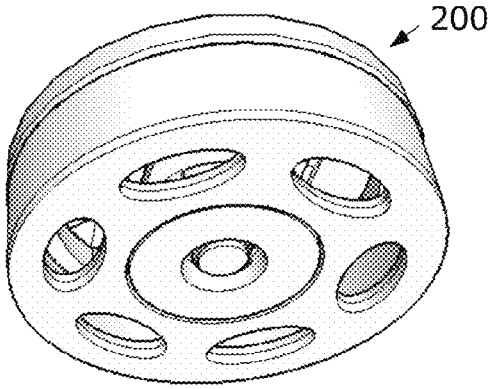
FIG. 7B is a bottom perspective view of the accessory cinching device for footwear in an assembled configuration according to the present disclosure.
Figure 7C:
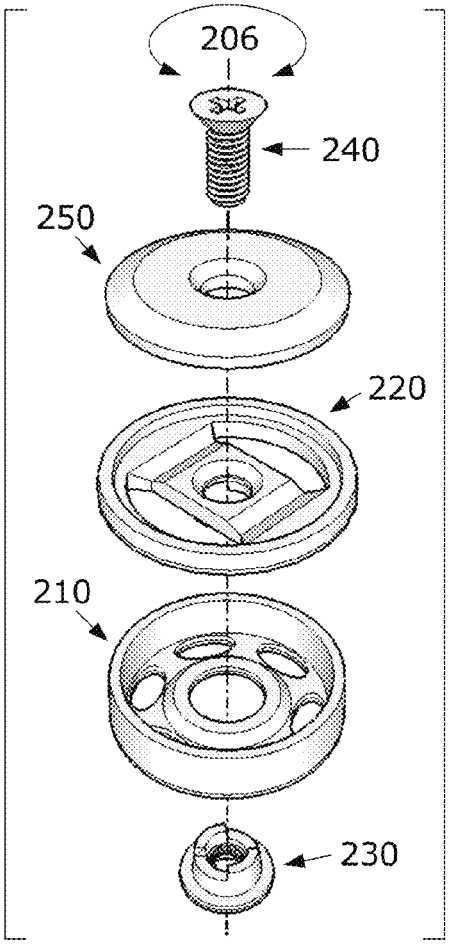
FIG. 7C is an exploded, top perspective view of the accessory cinching device for footwear according to the present disclosure.
Figure 7D:
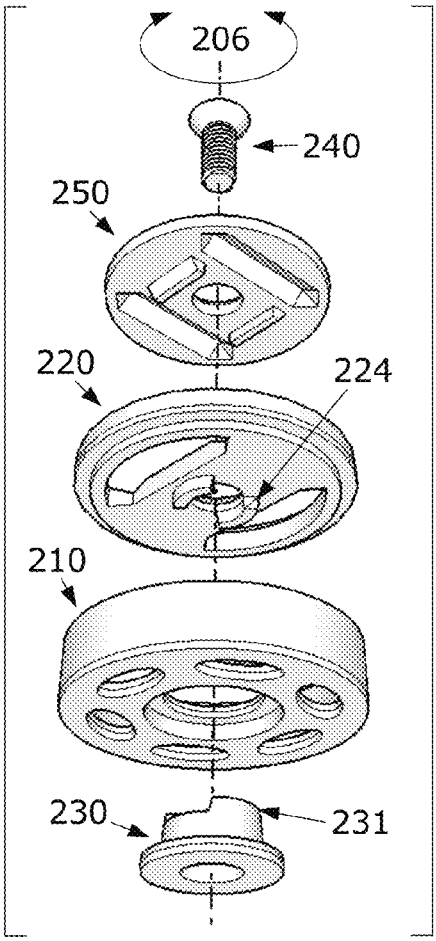
FIG. 7D is an exploded, bottom perspective view of the accessory cinching device for footwear according to the present disclosure.

In a second embodiment of the accessory cinching device of the present disclosure, FIGS. 7A and 7B are top and bottom perspective views of an accessory cinching device for footwear 200 shown in an assembled configuration. FIGS. 7C and 7D are exploded, top and bottom perspective views of the accessory cinching device for footwear 200 according to the present disclosure.

Figure 8A:
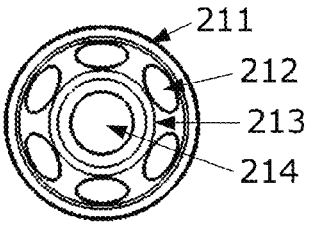
FIG. 8A is a top plan view of the stationary housing of the accessory cinching device for footwear according to the present disclosure.
Figure 9A:
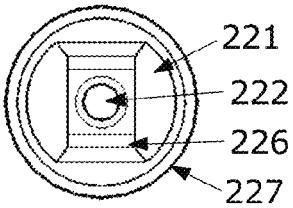
FIG. 9A is a top plan view of the rotating housing of the accessory cinching device for footwear according to the present disclosure.
Figure 8B:
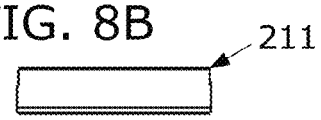
FIG. 8B is a side elevation view with front and rear views being the same of the stationary housing of the accessory cinching device for footwear according to the present disclosure.
Figure 9B:
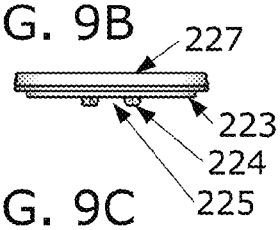
FIG. 9B is a front elevation view of the rotating housing of the accessory cinching device for footwear according to the present disclosure.
Figure 9D:
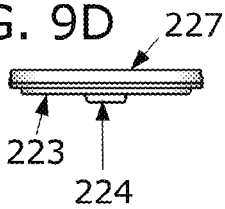
FIG. 9D is a side elevation view of the rotating housing of the accessory cinching device for footwear according to the present disclosure.
Figure 8C:
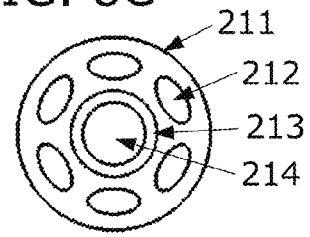
FIG. 8C is a bottom plan view of the stationary housing of the accessory cinching device for footwear according to the present disclosure.
Figure 9C:
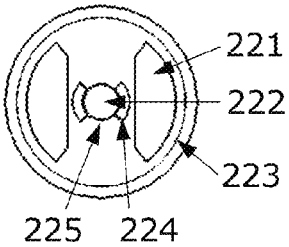
FIG. 9C is a bottom plan view of the rotating housing of the accessory cinching device for footwear according to the present disclosure.
Figure 10A:
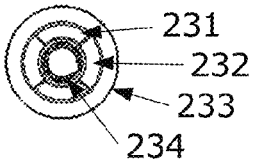
FIG. 10A is a top plan view of the retaining nut of the accessory cinching device for footwear according to the present disclosure.

FIGS. 8A-8C are top plan, side elevation, and bottom plan views of a stationary housing 210 of the accessory cinching device for footwear 200, respectively, according to the present disclosure.

As illustrated in FIGS. 7A-7D and FIGS. 8A-8C, the accessory cinching device 200 for securing shoelaces 201, 204 (FIG. 13) to a desired tightness or looseness includes a first cylindrical housing 210 configured to be stationary that has a side wall 211, a plurality of bottom line holes 212, a base collar 213, and a bottom core hole 214. The plurality of bottom line holes 212 are adapted to accommodate placement of the device 200 on top of the shoelaces 201, 204.

FIGS. 9A-9D are top plan, front elevation, bottom plan, and side elevation views of a rotating housing 220 of the accessory cinching device for footwear 200, respectively, according to the present disclosure.

As illustrated in FIGS. 7A-7D and FIGS. 9A-9D, the accessory cinching device for footwear 200 further includes a second cylindrical housing 220 configured to be rotating that has at least two top line holes 221, a top screw hole 222, a top collar 223, a top core 224 with at least two top core notches 225, at least two lower clamp guides 226, and a shield ring 227. The top collar 223 is configured to provide alignment of the rotating housing 220 disposed on top of the stationary housing 210.

FIGS. 10A-10D are top plan, side elevation, bottom plan, and front or rear elevation views of a retaining nut 230 of the accessory cinching device for footwear 200, respectively, according to the present disclosure.

As illustrated in FIGS. 7C-7D and FIGS. 10A-10D, the accessory cinching device for footwear 200 includes a retaining nut 230 having a bottom core 231 with at least two bottom core notches 232, a bottom lip 233, and an internal (female) thread 234. The bottom core 231 of the retaining nut 230 is adapted to be inserted up through the bottom core hole 214 of the stationary housing 210.

Figure 11A:
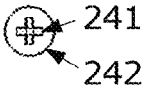
FIG. 11A is a top plan view of the screw of the accessory cinching device for footwear according to the present disclosure.
Figure 10B:
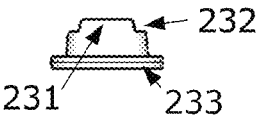
FIG. 10B is a side elevation view of the retaining nut of the accessory cinching device for footwear according to the present disclosure.
Figure 10D:
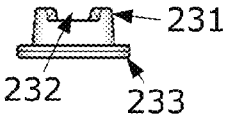
FIG. 10D is a front or rear elevation view of the retaining nut of the accessory cinching device for footwear according to the present disclosure.
Figure 11B:
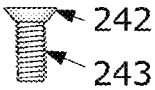
FIG. 11B is a front elevation view of the screw of the accessory cinching device for footwear according to the present disclosure.
Figure 10C:
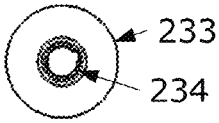
FIG. 10C is a bottom plan view of the retaining nut of the accessory cinching device for footwear according to the present disclosure.
Figure 11C:
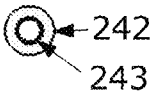
FIG. 11C is a bottom plan view of the screw of the accessory cinching device for footwear according to the present disclosure.
Figure 12A:
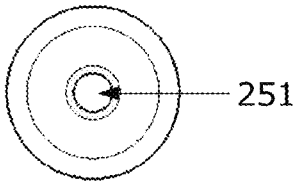
FIG. 12A is a top plan view of the cap of the accessory cinching device for footwear according to the present disclosure.
Figure 12B:
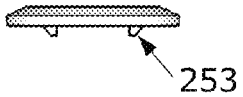
FIG. 12B is a front elevation view of the cap of the accessory cinching device for footwear according to the present disclosure.
Figure 12D:
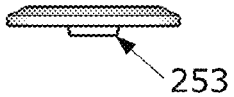
FIG. 12D is a side elevation view of the cap of the accessory cinching device for footwear according to the present disclosure.
Figure 12C:
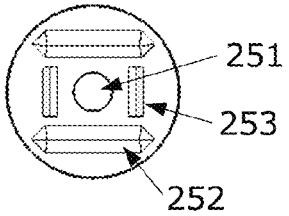
FIG. 12C is a bottom plan view of the cap of the accessory cinching device for footwear according to the present disclosure.

FIGS. 11A-11C are top plan, front elevation, and bottom plan views of a screw 240 of the accessory cinching device for footwear 200, respectively, according to the present disclosure.

As illustrated in FIGS. 7C-7D and FIGS. 11A-11C, the accessory cinching device for footwear 200 includes a screw 240 having a Phillips head indentation 241, a flat head 242, and an external elongated (male) thread 243, such that the screw is adapted to secure the rotating housing 220 to the retaining nut 230. A standard Phillips head screwdriver is used with the Phillips head indentation 241 in screw 240 to secure the cap 250 and the rotating housing 220 to the retaining nut 230. The at least two top core notches 225 of the rotating housing 220 and the at least two bottom core notches 232 of the retaining nut 230 are adapted to interlock to prevent the screw 240 from over-tightening or backing out when the rotating housing is turned during operation of the accessory cinching device 200.

FIGS. 12A-12D are top plan, front elevation, bottom plan, and side elevation views of a cap 250 of the accessory cinching device for footwear 200, respectively, according to the present disclosure.

As illustrated in FIGS. 7C-7D and FIGS. 12A-12D, the accessory cinching device for footwear 200 further includes a cap 250 having a cap screw hole 251, at least two upper clamp guides 252, and at least two braces 253. The at least two braces 253 and the shield ring 227 are adapted to provide alignment of the cap 250 with the rotating housing 220.

The base collar 213 and the bottom lip 233 are adapted to maintain the assembly comprising the rotating housing 220, the retaining nut 230, the screw 240, and the cap 250, in alignment while allowing the assembly to rotate relative to the stationary housing 210 when securing the shoelaces 201, 204 (FIG. 13) to the desired tightness or looseness.

In accordance with the present disclosure, the first cylindrical housing 210 and the second cylindrical housing 220 are configured to be concentric with each other in an assembled configuration as shown in FIGS. 7A and 7B.

Figure 13:
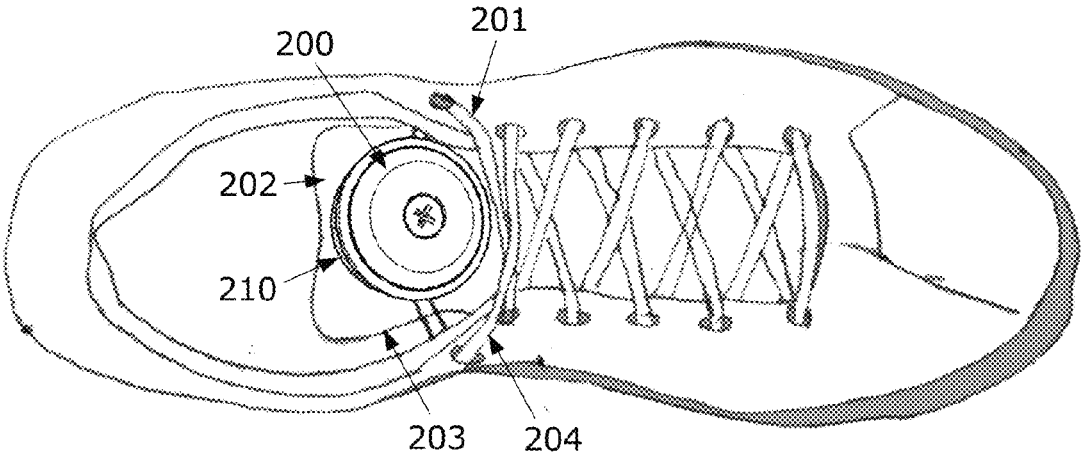
FIG. 13 is a top application of the accessory cinching device of FIG. 7A according to the present disclosure.

In assembly of the accessory cinching device 200, the rotating housing 220 is configured to be positioned over the stationary housing 210 and the retaining nut 230 and aligned so that the top core 224 and the bottom core 231 interlock as shown in FIG. 7D. The resulting partial assembly of the accessory cinching device 200 is configured to be positioned over the shoelaces 201, 204 on a top surface 202 of a shoe tongue 203 with the stationary housing 210 facing downward as shown in FIG. 13.

In the initial set-up of the accessory cinching device 200, a left shoelace 201 is threaded upward through the closest bottom line hole 212 on the stationary housing 210. The shoelace 201 is then threaded out through one top line hole 221 and the shoelace end is positioned over one lower clamp guide 226 of the rotating housing 220. A right shoelace 204 is threaded upward through the opposite bottom line hole 212 on the stationary housing 210. The right shoelace 204 is then threaded out through the other top line hole 221 in the rotating housing 220 and the shoelace end is positioned over the other lower clamp guide 226 of the rotating housing. The at least two lower clamp guides 226 of the rotating housing 220, when aligned with the at least two upper clamp guides 252 of the cap 250, allow the shoelace ends to be secured in place and prevent the shoelace ends from being pulled back into the accessory cinching device 200 during operation. Cap 250 is disposed over the rotating housing 220 and the shoelace ends are secured between the upper and lower clamp guides 252 and 226. Screw 240 is inserted through cap 250 and rotating housing 220 and is fastened to retaining nut 230 as shown in FIGS. 7C and 7D. The resulting assembly of the accessory cinching device 200 rotates relative to the stationary housing 210 and can be turned to tighten or loosen the shoelaces.

In accordance with the present disclosure, the top core 224 of the rotating housing 220 and the bottom core 231 of the retaining nut 230 are adapted to form a spool (FIG. 7D) around which the shoelaces 201, 204 (FIG. 13) wrap when the rotating housing 220 is turned relative to the stationary housing 210. The shoelaces 201, 204 are wrapped around the spool centered on an axis of rotation 206. The rotating housing 220 winds the shoelaces 201, 204 around the spool and tightens the shoelaces externally when the rotating housing is rotated in a tightening direction (e.g., clockwise). The rotating housing 220 unwinds the shoelaces 201, 204 around the spool and loosens the shoelaces externally when the rotating housing is rotated in a loosening direction (e.g., counterclockwise). It should be understood that since there is no unidirectional ratcheting mechanism, the tightening direction can be either clockwise or counterclockwise, according to the user's choice, and the loosening direction is then the opposite of the chosen tightening direction. The accessory cinching device 200 is configured to use friction to secure the shoelaces to the desired tightness or looseness.

It should be understood that both embodiments of the accessory cinching device 100 and 200 can be fabricated into any suitable size and are sized to scale depending on the application. In some embodiments, the dimensions of the accessory cinching device for jewelry 100 include a height of about 6 mm (0.24 inches) and a diameter of about 21 mm (0.83 inches). In some embodiments, the dimensions of the accessory cinching device for footwear 200 include a height of about 13 mm (0.51 inches) and a diameter of about 35 mm (1.38 inches).

It is contemplated by the present disclosure that the various components of the accessory cinching device 100 and 200 can be made from different materials. In particular, the accessory cinching device 100 and 200 can be made of any sufficiently rigid and strong material such as plastic, wood, metal, or combinations thereof, and the like.

Several of the features and functions disclosed above may be combined into different apparatus, systems or applications, or combinations of apparatus, systems and applications. Various presently unforeseen or unanticipated alternatives, modifications, variations or improvements therein may be subsequently made by those skilled in the art, each of which is also intended to be encompassed by the following claims.

What is claimed is:

1. An accessory cinching device for securing shoelaces to a desired tightness or looseness, comprising:

a first cylindrical housing configured to be stationary and having a side wall, a base collar, a plurality of bottom line holes, and a bottom core hole, wherein the plurality of bottom line holes are adapted to accommodate placement of the device on top of the shoelaces;

a second cylindrical housing configured to be rotating and having at least two top line holes, a top screw hole, a top collar, a top core with at least two top core notches, at least two lower clamp guides, and a shield ring, wherein the top collar is configured to provide alignment of the rotating housing disposed on top of the stationary housing;

a retaining nut having a bottom core with at least two bottom core notches, a bottom lip, and an internal thread, wherein the bottom core of the retaining nut is adapted to be inserted up through the bottom core hole of the stationary housing;

a screw having a flat head and an external elongated thread, wherein the screw is adapted to secure the cap and the rotating housing to the retaining nut, and the at least two top core notches of the rotating housing and the at least two bottom core notches of the retaining nut are adapted to interlock to prevent the screw from over-tightening or backing out when the rotating housing is turned;

a cap having a cap screw hole, at least two upper clamp guides, and at least two braces, wherein the at least two braces and the shield ring are adapted to provide alignment of the cap with the rotating housing;

wherein the base collar and the bottom lip are adapted to maintain the joined rotating housing, the retaining nut, the screw, and the cap, in alignment while allowing the device to rotate relative to the stationary housing when securing the shoelaces to the desired tightness or looseness.

2. The device of claim 1, wherein the first cylindrical housing and the second cylindrical housing are configured to be concentric with each other in an assembled configuration.

3. The device of claim 1, wherein the rotating housing is configured to be positioned over the stationary housing and aligned so that the top core and the bottom core interlock.

4. The device of claim 1, wherein the at least two lower clamp guides of the rotating housing, when aligned with the at least two upper clamp guides of the cap, allow shoelace ends to be secured in place and prevent the shoelace ends from being pulled back into the device during operation.

5. The device of claim 1, wherein the top core of the rotating housing and the bottom core of the retaining nut are adapted to form a spool around which the shoelaces wrap when the rotating housing is turned relative to the stationary housing.

6. The device of claim 5, wherein the shoelaces are wrapped around the spool centered on an axis of rotation.

7. The device of claim 5, wherein the rotating housing winds the shoelaces around the spool and tightens the shoelaces externally when the rotating housing is rotated in a tightening direction.

8. The device of claim 5, wherein the rotating housing unwinds the shoelaces around the spool and loosens the shoelaces externally when the rotating housing is rotated in a loosening direction.

9. The device of claim 1, wherein the device is configured to use friction to secure the shoelaces to the desired tightness or looseness.

10. The device of claim 1, wherein the device is configured to be positioned over the shoelaces on a top surface of a shoe tongue with the stationary housing facing downward.

* * * * *